United States Patent [19]

Bowes

[11] Patent Number: 5,038,702

[45] Date of Patent: Aug. 13, 1991

[54] SEMI-SUBMERSIBLE PLATFORM

[75] Inventor: Julian F. Bowes, Houston, Tex.

[73] Assignee: Marathon LeTourneau Company, Longview, Tex.

[21] Appl. No.: 421,823

[22] Filed: Oct. 16, 1989

Related U.S. Application Data

[63] Continuation of Ser. No. 714,367, Mar. 21, 1985, Pat. No. 4,909,174, which is a continuation-in-part of Ser. No. 525,827, Aug. 23, 1983, abandoned.

[51] Int. Cl.[5] ..... B63B 35/44

[52] U.S. Cl. ..... 114/265; 114/264

[58] Field of Search ..... 114/264, 265, 266, 230, 114/125, 126; 405/224, 121, 211, 217

[56] References Cited

U.S. PATENT DOCUMENTS 3,160,135 12/1964 De Vries ..... 114/265

3,490,406 1/1970 O'Reilly et al. ..... 114/265

4,112,864 9/1978 Bergman ..... 114/265

*Primary Examiner*—Ed Swinehart

*Attorney, Agent, or Firm*—Vinson & Elkins

[57] ABSTRACT

A semi-submersible platform supported on columns with pontoons extending between and outboard of the columns. Damper plates are provided by flat surfaces either on top of the outboard section of the pontoons or by plates positioned on the columns above the pontoons to provide heave and pitch stabilization and motion phase control in relation to the wave action such that when the platform is in the drilling mode, the heave phase of the platform is approximately one hundred eighty degrees out of phase with wave action, and in the survival mode, heave action of the platform is substantially in phase with wave action, such that the platform will ride with the storm waves allowing the use of shorter columns than the current art.

2 Claims, 9 Drawing Sheets

SEMI-SUBMERSIBLE PLATFORM

This application is a continuation of co-pending application Ser. No. 06/714,367, filed Mar. 21, 1985 now U.S. Pat. No. 4,909,174, issued Mar. 20, 1990, which was a continuation-in-part of application Ser. No. 06/525,827, filed Aug. 23, 1983 now abandoned.

This invention relates to semi-submersible platforms. The typical semi-submersible floating platform includes semi-immersed vertical support columns in the form of closed hollow tubes supporting a work platform above water level and connected at the lower end of the columns to submerged horizontal pontoons. In typical sea states this layout offers a large work platform with a minimum of wave induced motion in the operational mode as the major portion of volume is positioned well below the wave-exciting forces and the relatively small cross-section of the columns offers a minimal restoring force as the wave front passes.

This motion reduction is essential for the various drilling, oil and gas production, diving and construction support-type operations that offshore platforms are used for.

Bergman U.S. Pat. No. 4,112,864 teaches distributing the volume of pontoons non-uniformly towards the end to reduce the vertical component of wave induced forces acting between the pontoons and columns in the sub-resonant region. This design aims to reduce motion while in the operating or drilling mode for which heave reduction is most important. This prior art designs, however, ignore the effect when the vessel must be raised to a storm survival mode.

Primarily the reduced heave motions do not allow large waves, seventy feet plus, to clear the underside of the work platform. The only solution has been to lengthen the columns to raise the work platform above the largest anticipated storm wave crest. This is done at the monetary expense of extra steel, reduced pay load and reduced stability due to a higher center of gravity.

The design of Bergman and other prior art semi-submersible columns utilizing pontoons result in a vessel which in both the drilling and the survival mode heaves approximately one hundred eighty degrees out of phase with wave action. Thus, with the wave crest passing the platform the platform, heave motion positions the platform at its lowest level, thus reducing the clearance below the platform.

While damping of heave action is known (see the reference in Bergman to the use of dampers in a copending application), damping has not been utilized to shift the heave motion phase of a semi-submersible to approximately the zero degree position where the vessel heaves in phase with the wave action so that the vessel rides with the waves in the manner of a cork on the surface to obtain maximum clearance of the work platform above wave level. This phase shift permits shortening of the columns and lightening of the overall vessel to clear a given height wave during the survival mode.

It is an object of the present invention to dampen heave action of a semi-submersible platform during the time that the vessel is in the survival mode to provide favorable heave suppression at resonance and to shift the phase of heave action from approximately one hundred eighty degrees relative to wave action while in the drilling mode to an approximately zero phase difference between heave action of the platform and waves while in the survival mode to permit the platform to ride with large waves when in a storm survival mode.

Another object is to provide for damping of a semi-submersible platform by providing large flat damping surfaces positioned outboard of the columns and facing upwardly such that damping is provided in the vertical or heave direction along with a pitch damping moment sufficiently large as to prevent the hulls from breaking through the sea surface.

Another object is to provide dampers for semi-submersible platforms by forming the outboard pontoons with substantially flat upper surfaces which are large in area relative to the total column horizontal cross-sectional area to provide adequate damping versus heave stiffness.

Another object is to provide dampers in a semi-submersible platform such that the total outer pontoon volume is less per unit area of outer damping surface than the inner pontoon volume per unit area of inner pontoon top surface.

Another object is to provide dampers in a semi-submersible platform by providing outer pontoons with large flat areas which are positioned vertically above the upper surface of the portions of the pontoons extending between columns and combined with the proceeding object to provide the inner pontoon center of volume below that of the outer pontoons center such that the major body of pontoon volume is positioned below the region of largest wave excitation forces.

Another object is to provide a semi-submersible platform as in the preceding object in which the upper surfaces of the inner pontoons are above water line during towing mode and the inner pontoon vertical center of volume is below that of the outboard pontoon sections to increase stability.

Another object is to provide a semi-submersible vessel having outboard pontoons with flat upper surfaces to act as dampers in which the upper surfaces are positioned to substantially reduce the d/T ratio of the outer pontoons during operation of the vessel at survival modes.

Other objects, features and advantages of the invention will be apparent from the drawings, the specification and the claims.

In the drawings wherein like reference numerals indicate like parts, and wherein illustrative embodiments of this invention are shown:

Figure 3A:
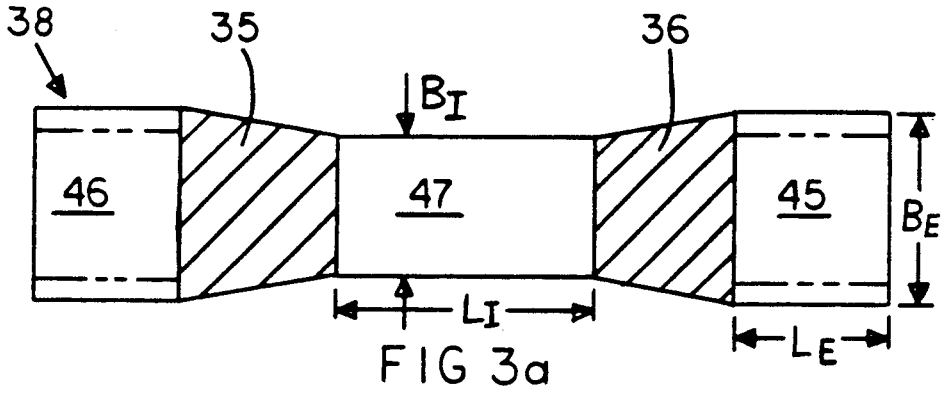
Figure 3B:
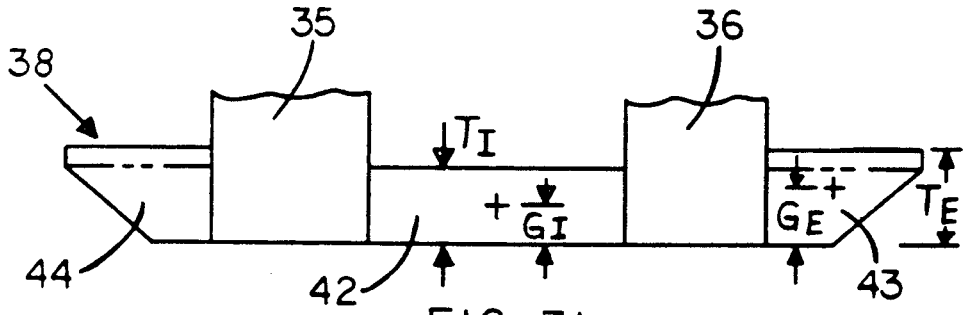
Figure 4A:
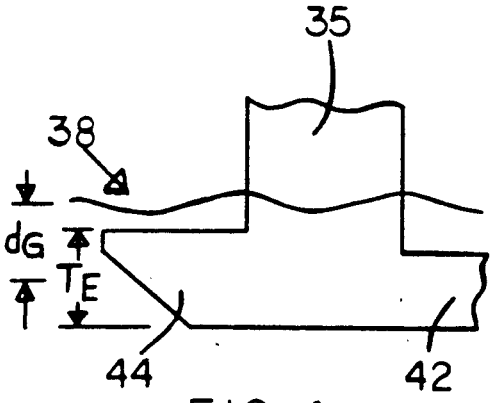
Figure 4B:
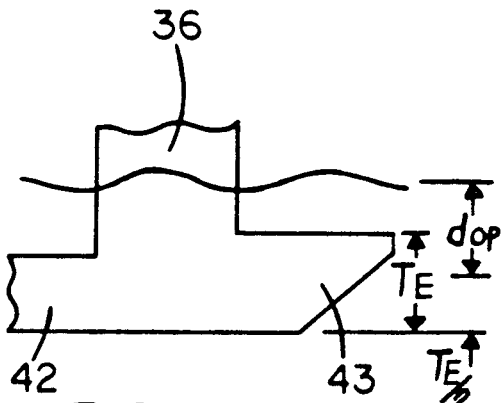
Figure 5A:
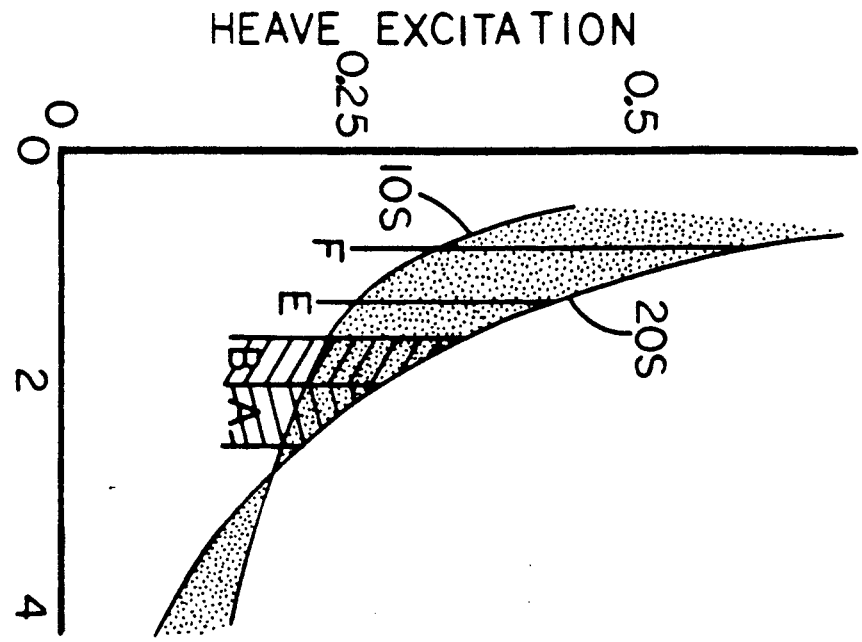
Figure 5B:
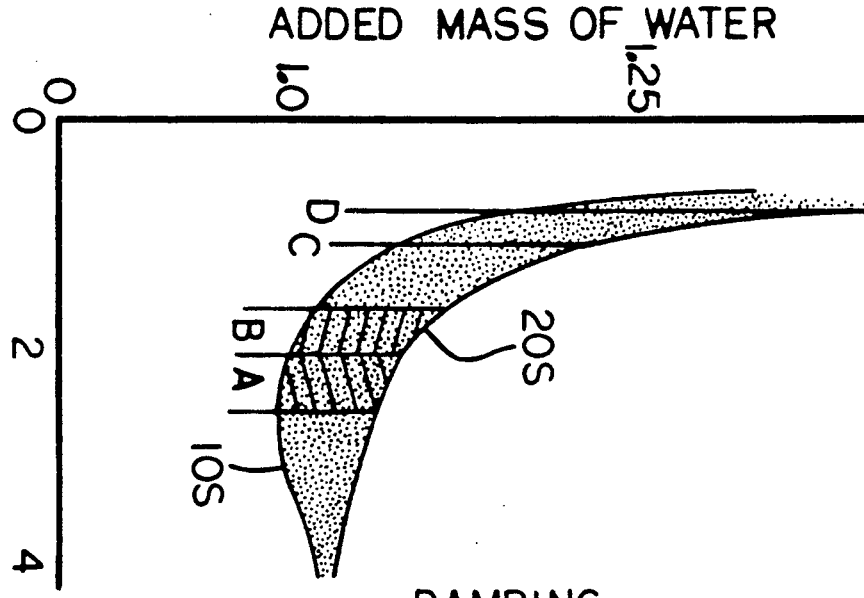
Figure 5C:
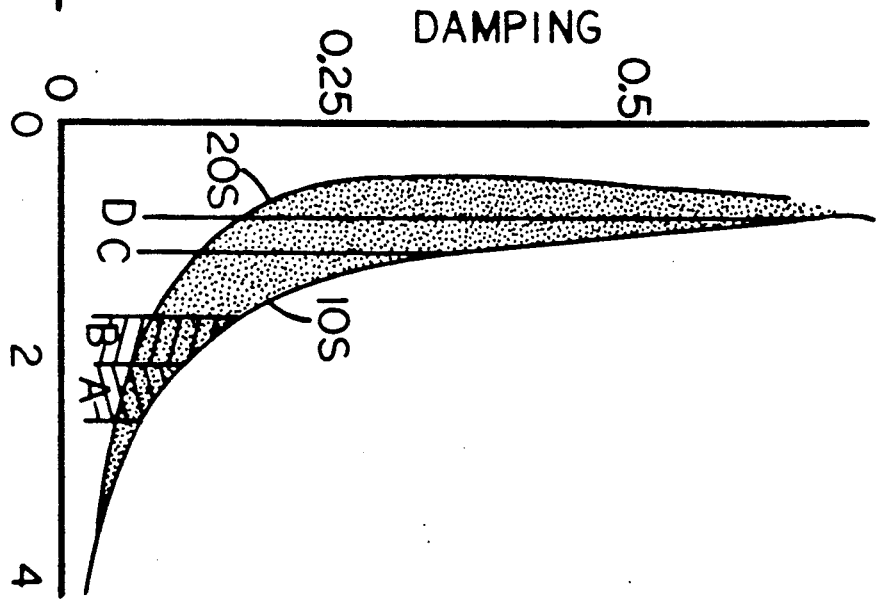
Figure 6A:
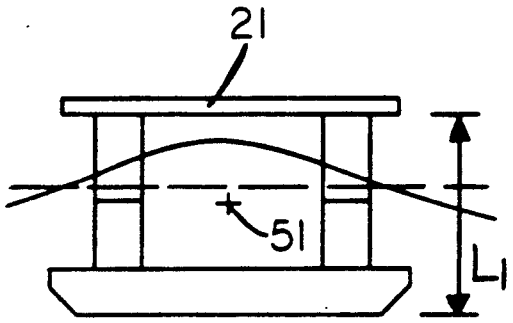
Figure 7A:
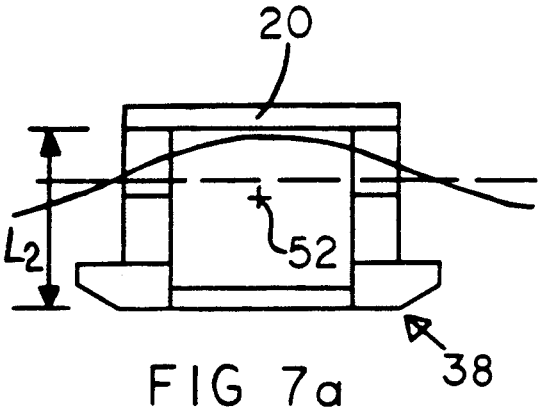
Figure 6B:
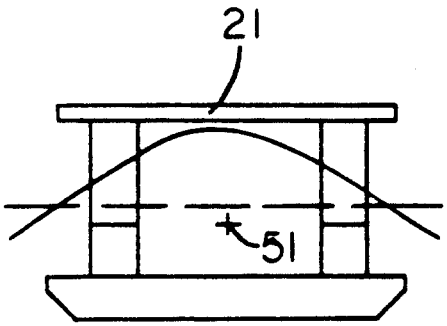
Figure 7B:
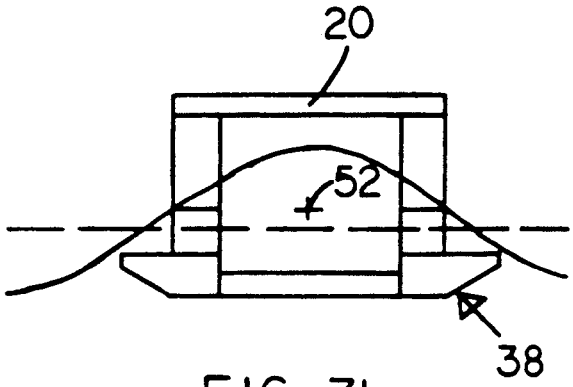
Figure 8:
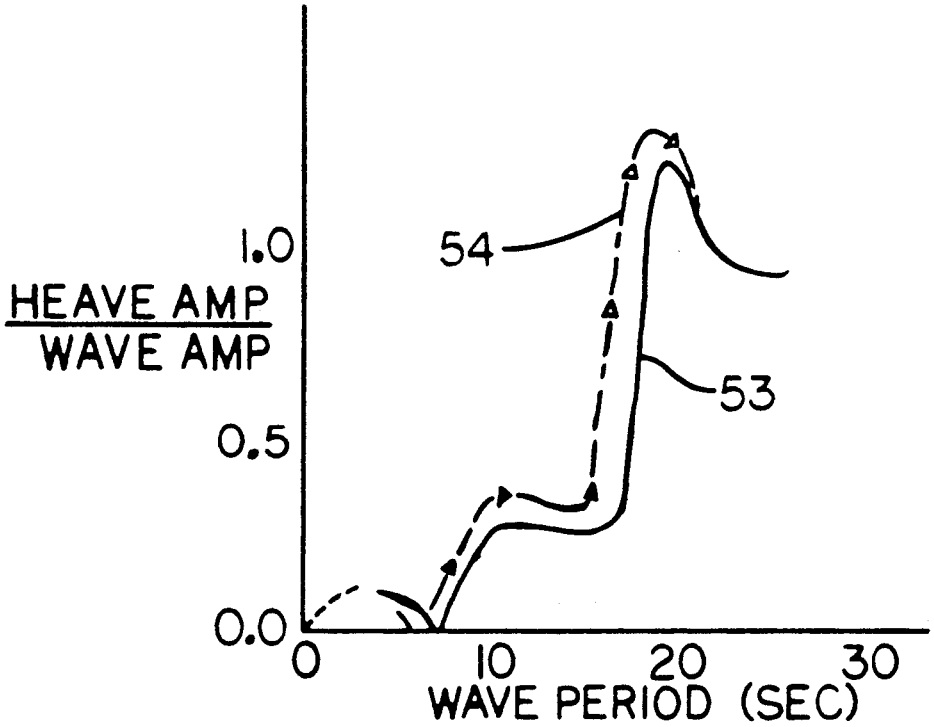
Figure 9:
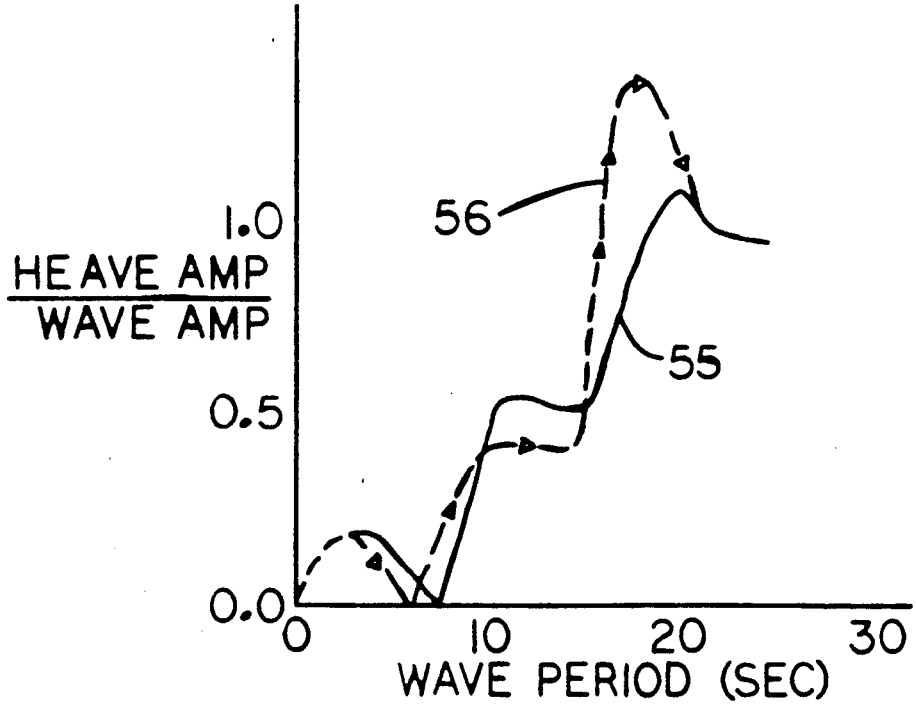
Figure 10A:
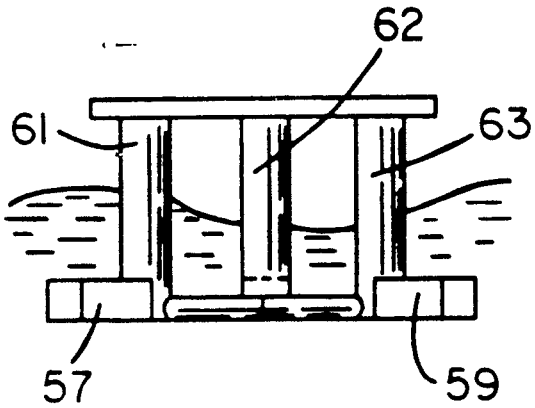
Figure 10B:
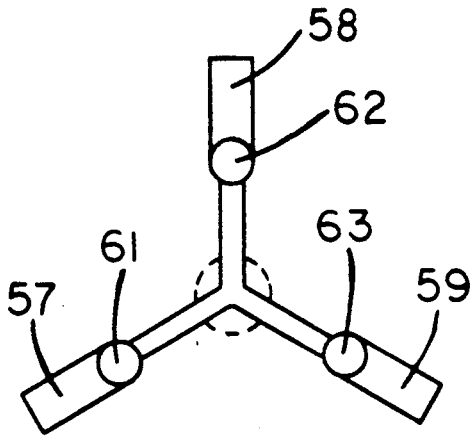
Figure 11A:
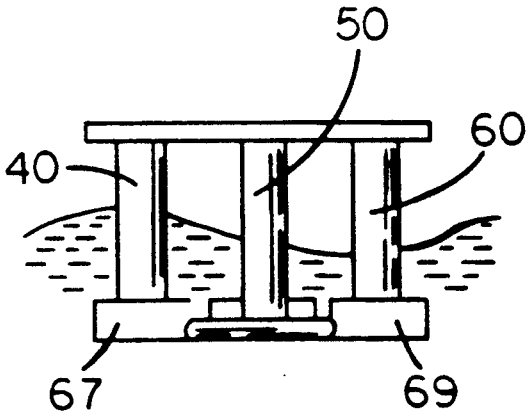
Figure 11B:
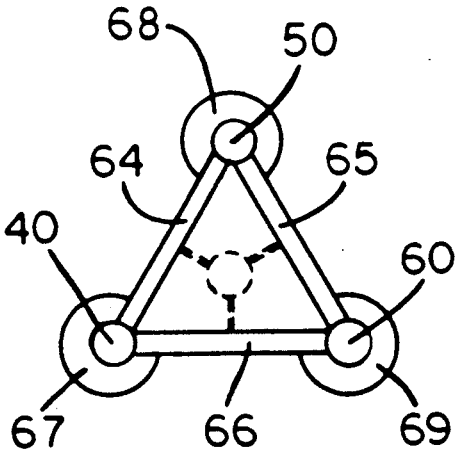
Figure 12:
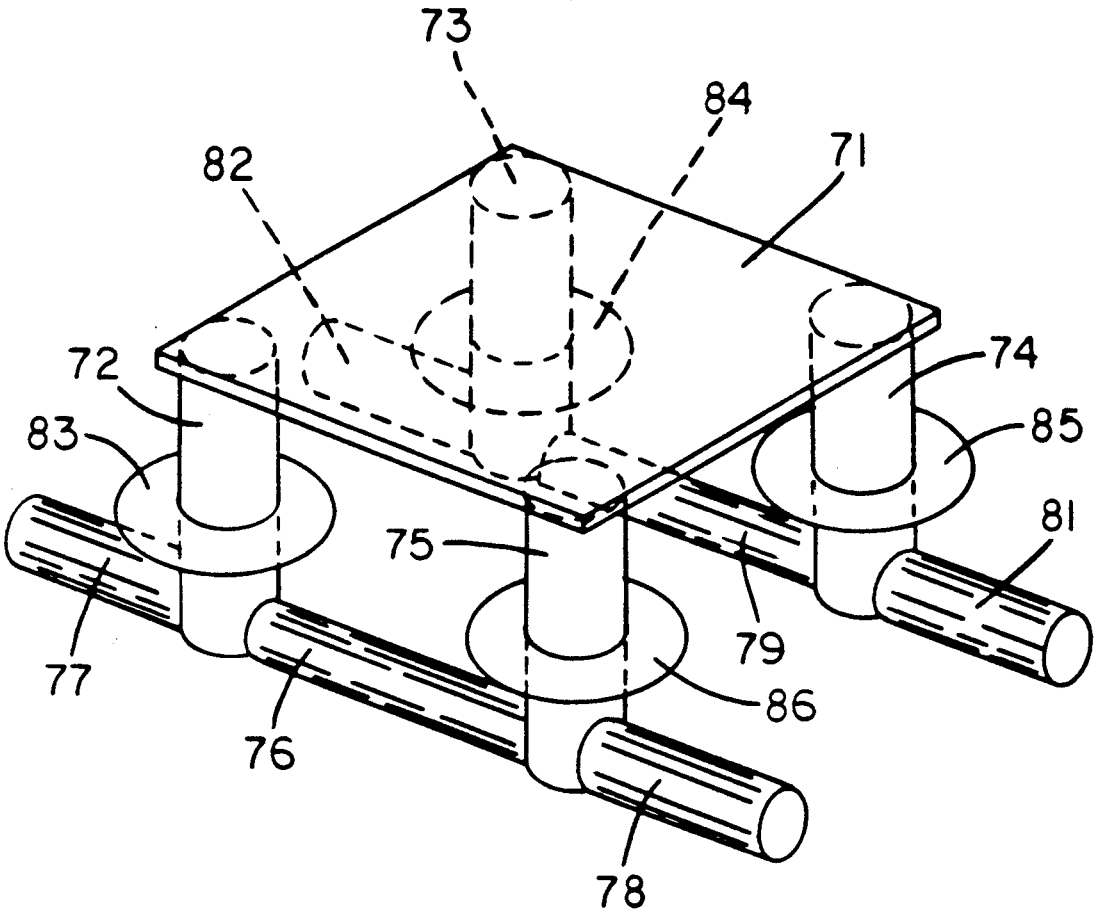
Figure 13A:
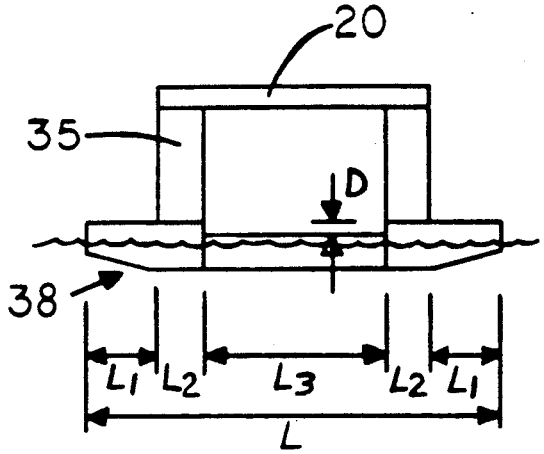
Figure 13B:
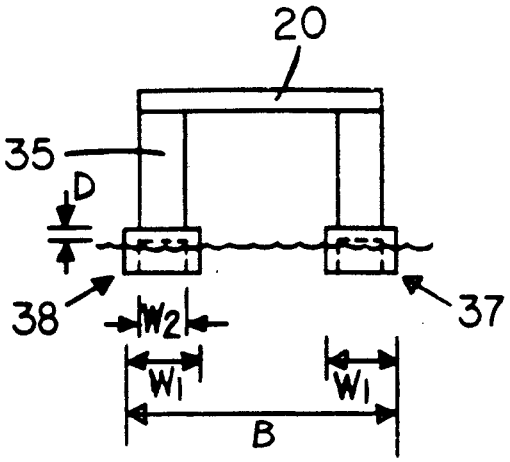
Figure 14A:
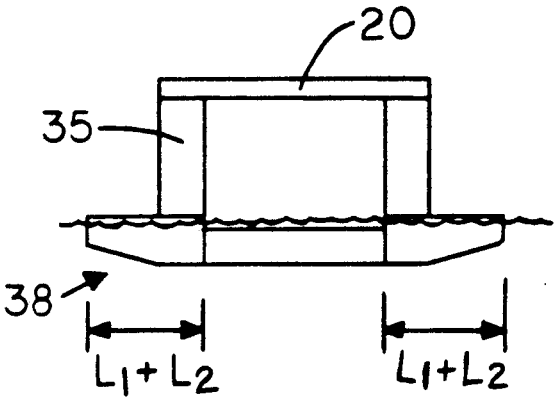
Figure 14B:
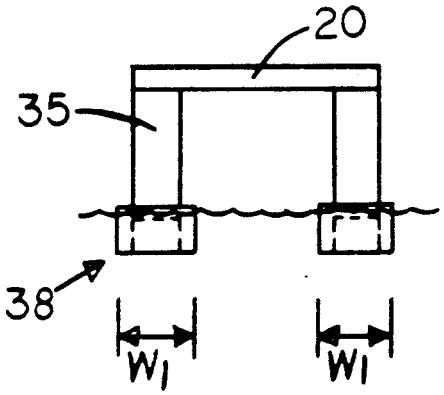
Figure 15A:
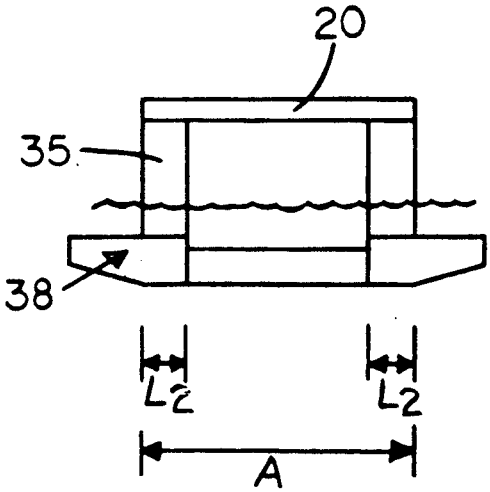
Figure 15B:
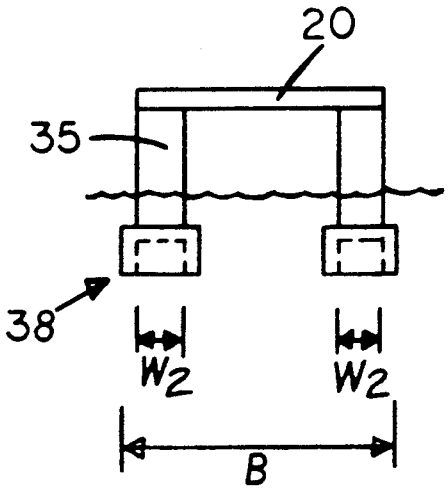

FIG. 3*a* is a plan view of a pontoon constructed according to the principles of this invention;

FIG. 3*b* is a profile view of a pontoon constructed according to the principles of the present invention;

FIG. 4*a* is a profile view of one end of the FIG. 3 pontoon shown in relation to the water surface at survival mode;

FIG. 4*b* is a profile view of one end of the FIG. 3 pontoon shown at operational mode;

FIG. 5*a* is a plot of heave exciting force as a function of d/T in the range of ten to twenty second period seas;

FIG. 5*b* is a plot of added mass as a function of d/T in the range of ten to twenty second period seas;

FIG. 5*c* is a plot of damping as a function of d/T in the range of ten to twenty second period seas;

FIGS. 6*a* and 6*b* are profile views of a conventional semi-submersible vessel at operating and survival drafts, respectively, showing wave clearance due to phase of vessel motion;

FIGS. 7*a* and 7*b* are profile views of a vessel constructed in accordance with this invention at operational and survival drafts, respectively, showing wave clearance due to phase of motion and contrasting with FIGS. 6*a* and 6*b* the relative positions of the platform and waves, particularly in the survival mode even though the columns of FIGS. 1*a* and 1*b* vessels are shorter than those of the FIGS. 6*a* and 6*b* vessel;

FIG. 8 is a graph illustrating the heave response of a semi-submersible embodying the present invention compared with the heave response of a conventional platform when both platforms are in the operating mode;

FIG. 9 is a graph illustrating the heave response of a semi-submersible embodying the present invention compared with the heave response of a conventional platform with both platforms in the storm mode;

FIGS. 10*a* and 10*b* are profile and plan views, respectively, of another embodiment of a semi-submersible platform constructed according to the principles of the present invention;

FIGS. 11*a* and 11*b* are profile and plan views, respectively, of still another embodiment of a semi-submersible platform constructed according to the principles of the present invention;

FIG. 12 is a perspective view of still another embodiment of a semi-submersible platform constructed according to the principles of the present invention; and FIGS. 13 through 15 illustrate the two-step stability transition as a semi-submersible constructed according to the principles of the present invention ballast from transit draft to operating mode with FIGS. 13*a* and 13*b* showing side and end profile views of the vessel in the transit mode, FIGS. 14*a* and 14*b* showing side and end elevation views of the vessel pontoons partially submerged, and FIGS. 15*a* and 15*b* being side and end elevational views of the vessel in the operating mode.

Figure 1:
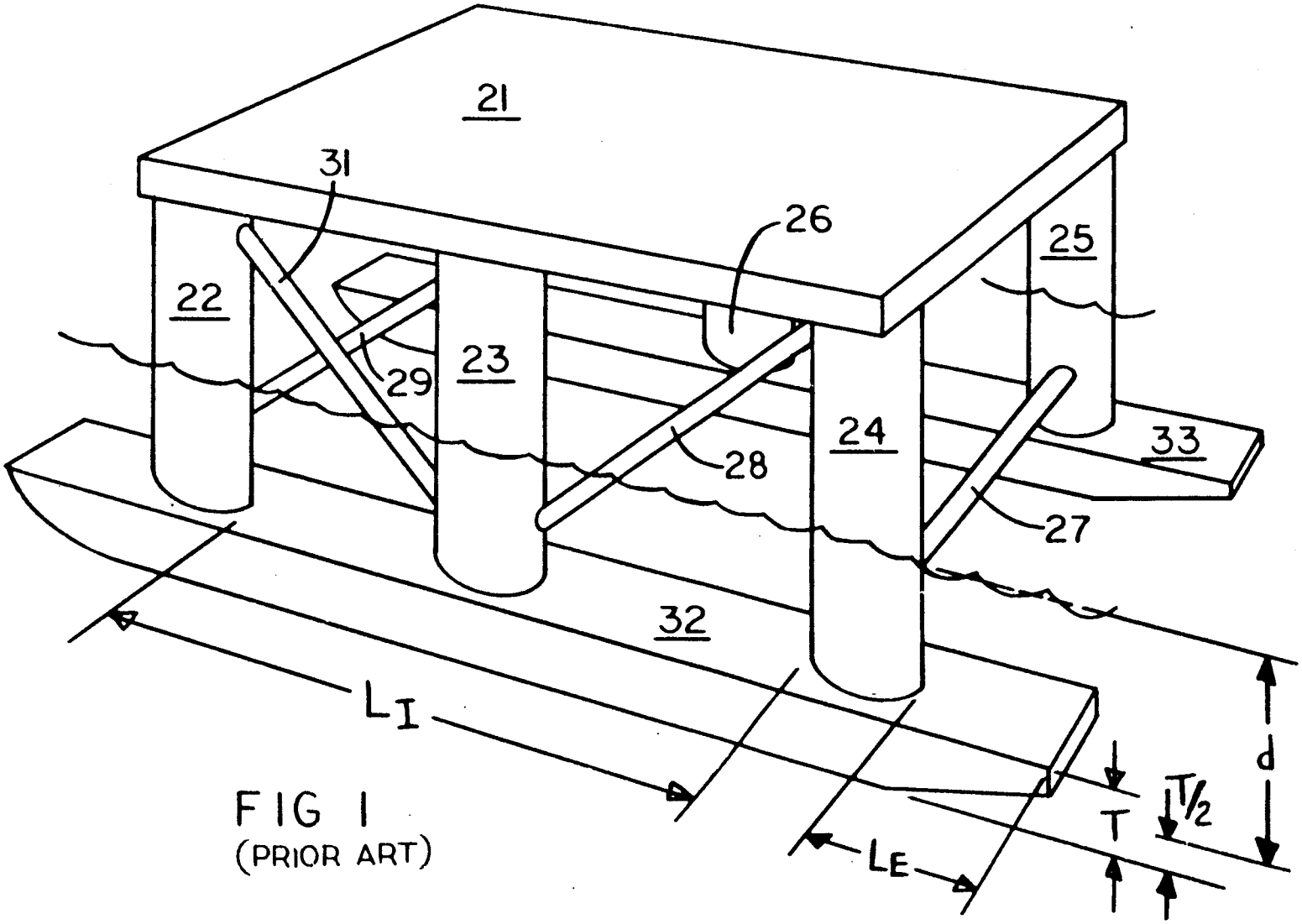
FIG 1 (PRIOR ART)
FIG. 1 is a perspective view of a conventional semi-submersible design of the current art as used by industry.

FIG. 1 depicts a semi-submersible structure of the type presently used for offshore operations. The working platform 21 is supported on a plurality of columns 22, 23, 24, 25, 26 and a sixth column which is positioned behind column 23 and not shown. Suitable cross-bracing 27, 28, 29 and 31 may extend between the several columns.

Pontoons 32 and 33 extend parallel to each other and pontoon 32 interconnects the columns 22, 23 and 24 while pontoon 33 interconnects columns 25, 26 and the hidden column.

The pontoon dimension $L_I$ extending between the outboard columns 22 and 24 is relatively large as compared to the outboard length $L_E$ of the pontoon. As the length $L_E$ is relatively small, there is a lack of area of the outboard sections of the pontoons relative to the inboard sections of the pontoons.

In use the vessel of FIG. 1 is normally operated at a d/T ratio of 2.0 to 2.5. The d/T ratio is illustrated in FIG. 1 with T being the vertical distance between the bottom and top of the pontoon and d being the distance from the water line to T/2 or one-half the vertical dimension of T.

In the survival mode a required air gap of fifty feet plus requires the vessel to be floated at a higher level with the d/T values in the 1.5 to 2.0 range.

With the vessel constructed as shown in the Bergman patent, the d/T ratio for operations would be around 1.875.

Both the platforms shown in FIG. 1 and the platform shown in the Bergman patent operate in both the operational and survival modes with the heave of the vessel being approximately one hundred eighty degrees out of phase with wave motion so that the vessel is at its lowest point as the crest of the wave passes under the platform.

The Bergman vessel, by distributing the per unit volume non-uniformly towards the pontoon ends, has shown the possibility of a near cancellation of the vertical components of wave induced forces acting between the pontoons and columns in the sub-resonant region. These designs and all other known designs, however, ignore the effect when the vessel must enter a storm survival mode.

Figure 2:
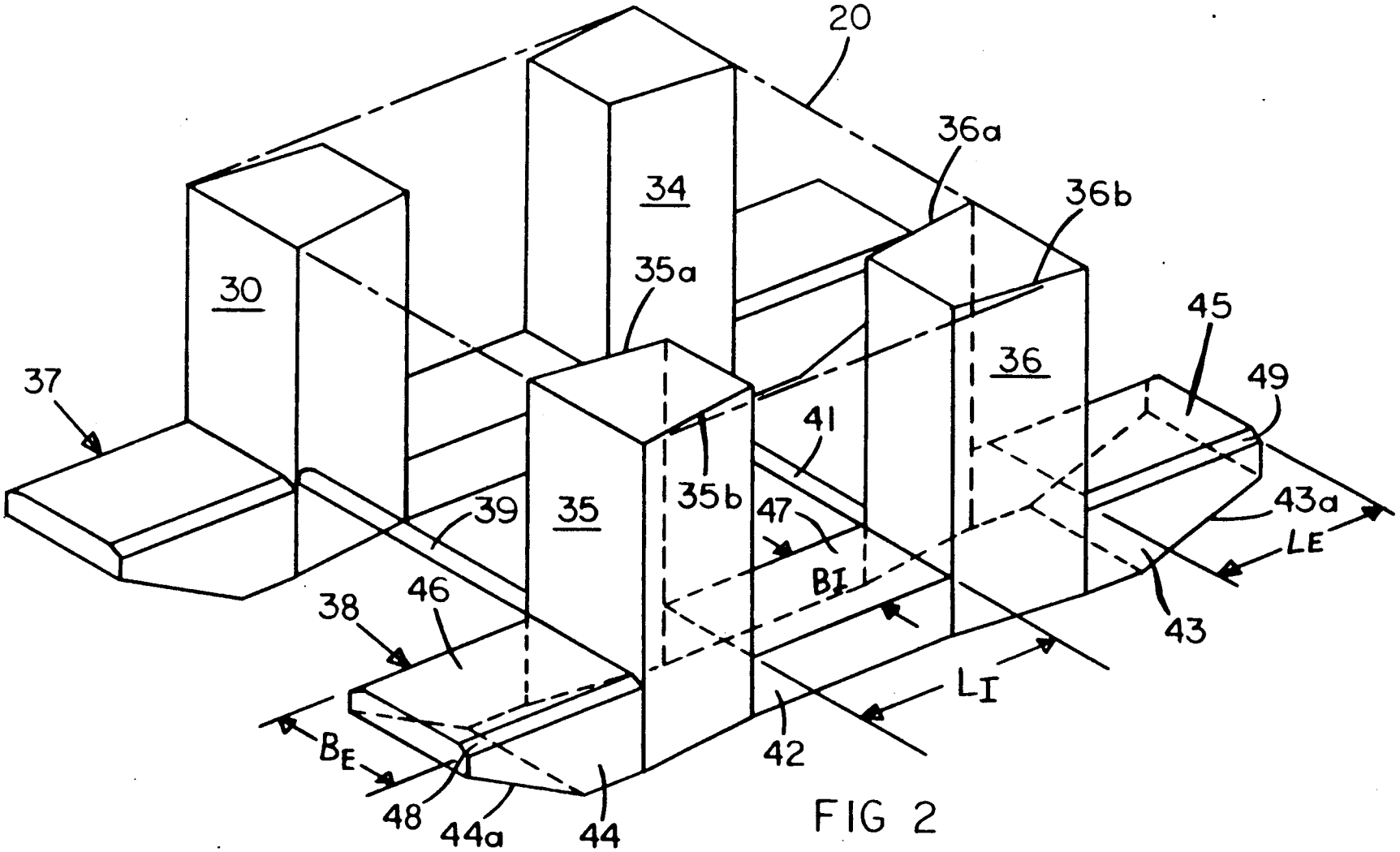
FIG. 2 is a perspective view of one embodiment of a semi-submersible constructed according to the principles of the present invention.

FIG. 2 illustrates a semi-submersible platform in accordance with the present invention which has all of the advantages of the Bergman platform plus the additional advantage of shifting the heave phase from one hundred eighty degrees out of phase with wave action as in Bergman, to approximately zero degrees between heave of the vessel and wave action so that the vessel will ride with the waves in the manner of a cork.

The vessel includes a platform which is indicated in dashed lines at 20 supported upon the four columns 30, 34, 35 and 36. These columns are substantially capable of providing buoyancy necessary for supporting the vessel and the pontoons indicated generally at 37 and 38 will be substantially filled with liquid when the platform is in the operational mode.

Suitable bracing, such as shown at 39 and 41, may extend between the several columns.

The two pontoons 37, 38 are identical and a description of one will be understood to apply to the two pontoons.

An inboard pontoon section 42 extends between the two columns 35 and 36 and outboard pontoon sections 43 and 44 extend beyond the two columns 35 and 36. If desired, the outboard pontoon section 44 may have an upwardly and outwardly inclined lower surface section 44*a* and a like upwardly and outwardly inclined section 43*a* may be provided on pontoon section 43. These surfaces extend above and below the water line when the platform is in the towing mode and reduce resistance to towing of the platform in the conventional manner.

To reduce resistance in towing it is preferred that the bottom of the pontoon 38 between the inclined surfaces 43*a* and 44*a* be formed as a continuation of the bottom of the columns 35 and 36 to present a smooth bottom surface to reduce resistance in towing.

In accordance with this invention the outer pontoon volumes are preferably approximately equal to or smaller than the inboard pontoon volumes. In the design illustrated it is preferred that the inner pontoon volume be 50.8 percent of the total pontoon volume. While a much less efficient design would result substantial advantage in the storm mode would be obtained with an inner pontoon volume down to about 43 percent of total pontoon volume. At less than this percentage it is believed that the efficiency of the rig during the storm mode will probably drop rapidly. Reduction in the outboard pontoon volume percentage below approximately 50 percent will not decrease the storm mode efficiency but a drastic reduction will effect drilling mode operations.

The pontoons further are so positioned that the inner pontoons are vertical center of volume and hence its center of buoyancy is below that of the outer pontoon sections 43 and 44. To accomplish the above, the upper surface 45 of outer pontoon section 43 and the upper surface 46 of the outer pontoon section 38 will be positioned at a higher elevation than the upper surface 47 of the inner pontoon section 42.

The upper surfaces 45 and 46 of the outer pontoon sections are flat or substantially flat to provide for maximum damping actions. Thus, in the illustrated form of the invention the two surfaces 45 and 46 are formed in single planes except that the edges may be chamfered, as at 48 and 49, if desired. The sum of the area of the flat surfaces 45 and 46 is about twenty percent greater than the horizontal cross-sectional area of the two columns 35 and 36 and is also greater than the area of the flat surface 47 of the inner pontoon. Thus, twice the length of the outer pontoon $L_E$ times the beam $B_E$ of the outer pontoon is greater than the length $L_1$ times the beam $B_1$ of the inner pontoon 42.

The area of surfaces 45 plus 46 divided by the volume of outer pontoon sections 43 plus 44 is greater than the area of surface 47 divided by the volume of inner pontoon section 42.

To obtain the lower center of inner pontoon section 42 the upper surface 47 of the inner pontoon will be positioned substantially below the upper surfaces 45 and 46 of the outer pontoons. However, it is preferred that the upper surface 47 of the inner pontoon be above the water line when the vessel is in the transit mode and for this purpose it may be desirable to reduce the beam of the inner pontoon to a width less than the beam of the two outer pontoons, as shown in the drawings. When this is done, it is preferred that the columns at the level of the pontoons have their side walls converging towards each other so that the sides of the pontoons will be a smooth, substantially continuous surface. For this purpose the side walls 35*a* and 35*b* of column 35 converge inwardly of the vessel towards the column 36 and the side walls 36*a* and 36*b* of column 36 converge inwardly of the vessel towards column 35. With this relationship the side walls of the column may mate with the side walls of the inboard and outboard pontoon sections to provide smooth flowing lines. This permits the vertical center of volume g1 of the inner pontoon to be positioned substantially lower than the center of volume $g_E$ of the outer pontoons. This results in positioning of the upper surfaces of the outer pontoons in closer proximity to the water surface to utilize the sharp increases in damping and added mass that result at shallow submergence depths while keeping the inner pontoons center of buoyancy $G_1$ as low as possible in relation to the position of the outer pontoon upper surfaces, placing a significant portion of the vessels volume in a deeper fluid region, reducing the unfavorable wave excitation forces. This force decreases exponentially with depth of submergence.

Thus, the design provides for a low center of buoyancy while providing for positioning the tops of the outboard pontoon sections at a high level to take advantage of high excitation forces at shallow depths.

In rough seas pitch of the platform must be controlled and this is accomplished by the large outboard pontoon sections. It will be appreciated by comparing the length $L_1$ with the length $L_E$ that the outboard pontoons extend outwardly from the columns a distance almost as great as the distance between columns 35 and 36. Thus, the flat top pontoon surfaces 45 and 46 extend for a substantial distance outboard of the platform. The damping effect of these outboard damping surfaces 45 and 46 is exerted a substantial distance from the platform center to not only control heave of the vessel but also to dampen pitch of the vessel and prevent the outboard pontoon sections from coming out of the water when the vessel is in survival mode, even though the design survival mode for the vessel is at a shallower draft than for conventional semi-submersible platforms.

The d/T ratio for vessels constructed in accordance with this invention will have approximately a ratio of 1.1 or greater at operational draft and 75 at survival draft, as best illustrated in FIGS. 4*a* and 4*b*. Due to the damping action provided by the upper surfaces of the large outboard pontoon sections, the vessel when in the survival mode will ride with the waves much in the manner of a cork and the phase of the vessel will be substantially the phase of the waves as contrasted with one hundred eighty degrees out of phase, as in the prior art.

This relationship is illustrated in FIGS. 6*a*, 6*b*, 7*a* and 1*b*. The height $L_1$ of the platform above the bottom of the pontoons of the prior art vessel is greater than the height $L_2$ of a vessel constructed in accordance with this invention, as illustrated in a comparison of FIG. 6*a* and 1*a*. At operational depths, the pontoons and columns of both vessels will cooperate in the same general manner to cause the vessel to heave at approximately one hundred eighty degrees out of phase with wave action. It will be noted that the center 51 of the prior art vessel shown in FIG. 6*a* is at substantially the same level as the center 52 of the vessel constructed in accordance with this invention shown in FIG. 1*a* when the two vessels are in the operational mode. Due to the shorter columns, the platform 32 does not have as much clearance as does the conventional vessel, but this is unimportant in the operational mode as ample clearance between the water line and the platform is present for the maximum operating wave of about forty feet. This figure is set by maximum heave motions and drilling equipment.

In the survival mode shown in FIG. 6*b*, the center 51 of the conventional vessel is below the water line while the center 52 of the vessel of this invention, as shown in FIG. 7*b*, is positioned above the mean water line raising the pontoons to a position where the outboard pontoon sections are subject to greater excitation forces to increase the effect of damping, resulting in a shift in phase to cause the vessel to be in phase with the waves and ride with the waves, as illustrated in FIG. 1*b*.

FIGS. 5*a*, 5*b* and 5*c* illustrate, respectively, the magnitude of heave excitation, added mass and damping force coefficients with respect to depth ratio, ie., d/T. The shaded region signifies the major energy range of sea states. The ten S-curve represents a ten second period sea, and twenty S, a twenty second sea. The hatched areas A and B depict the d/T ratio of a conventional semi-submersible in the operating zone and in the survival zone, respectively.

A shift from A to B gives about a three percent increase in heave added mass, a twenty-five percent increase in damping, and a twenty percent increase in excitation force. These are relatively minor changes. The C and D lines denote the d/T ratio of a semi-submersible constructed according to the principles of the present invention at operating and survival drafts, respectively. A shift from C to D gives about a fifteen percent increase in added mass and a seventy percent increase in damping. Lines E and F represent the adjusted d/T values 1.3 and 0.9 giving a thirty percent increase in excitation forces from operation to survival drafts. d/T has been adjusted to account for the greater difference between the pontoon upper surfaces and their volume center in this stepped hull form than is normal in a conventional pontoon.

Of greatest significance is the difference in heave added mass, damping and excitation forces between a conventional semi-submersible and a semi-submersible constructed according to the principles of the present invention. For a given operating condition, added mass has increased by fifteen percent allowing a fifteen percent larger column cross-section for a constant natural period. This increases stability and load capacity with no loss due to motions. Damping has increased in magnitude by two hundred percent, raising it from an insignificant force to one of major importance. This seventy percent change in heave damping force between operating and survival drafts combined with the magnitude of the initial damping at operating draft now gives a major phase shift in heave motion versus wave height elevation and brings the heave of the vessel into phase with wave form.

FIG. 8 plots heave amplitude/wave amplitude versus wave period in seconds. There is shown in curve 53 the heave response curve for a vessel constructed in accordance with this invention and in curve 54 the heave response curve for a conventional vessel when both vessels are in the operating mode. It is noted that there is an improvement in the heave response in the range of eight to fifteen seconds and a substantial reduction for the fifteen to eighteen second wave periods and at resonant frequency which has shifted to a higher period there is also a reduction in the amplitude.

In FIG. 9 the heave amplitude/wave amplitude is plotted again against wave period in seconds and shows at curve 55 a vessel in accordance with this invention and at curve 56 a conventional vessel when operating in the storm mode. While the vessel of this invention has a slightly greater heave amplitude in the ten to fifteen second range, there is a substantial decrease in heave amplitude between fifteen seconds and at the resonant frequency of the vessel. This is due to the extreme damping of the vessel constructed in accordance with this invention. This reduction of the extreme motions in the larger seas combined with a substantially zero degree phase angle allows the improved vessel of this invention to ride with the storm seas analogous to a cork following the water surface.

FIGS. 10*a* and 10*b* illustrate a symmetrical starlike distribution of the pontoons 57, 58 and 59. It will be noted that the outboard sections of the pontoons are again provided with flat top surfaces, have a higher center of buoyancy and are larger than the columns 40, 50 and 60 and that the sections of the pontoons outboard of the columns are also larger than the sections inboard of the columns.

FIGS. 11*a* and 11*b* illustrate another form of platform in which three columns 61, 62 and 63 are joined by three triangularly arranged inner pontoon sections 64, 65 and 66. Again, outer pontoon sections 67, 68 and 69 are provided outboard of the columns. The center of buoyancy, the areas, etc., are as defined hereinabove.

FIG. 12 shows a still further form of the invention. In this vessel the platform 71 is supported on four columns 72, 73, 74 and 75. The columns 72, 75 are interconnected by the inner pontoon section 76 and outboard pontoon sections 77 and 78 extend beyond the columns 72 and 75. In like manner, an inboard pontoon section 79 is provided between the columns 73 and 74 and outboard columns 81 and 82 extend beyond the columns 73 and 74. The construction of the vessel thus far described parallels that shown in the above identified Bergman patent.

In accordance with this invention, dampers 83, 84, 85 and 86 are supported on the columns 72, 73, 74 and 75, respectively. These dampers provide in their outboard sections the damping areas and functions discussed hereinabove and, additionally, the dampers are continued through a three hundred sixty degree circle for convenience of construction.

The application of the damper plates 83, 84, 85 and 86 to a vessel of the type shown in FIG. 12 would be effective to shift the phase of the vessel to bring it back into phase with wave action. It would, however, not permit the vessel to be constructed with the shorter columns, as with the vessel shown in FIG. 2. With the vessel of FIG. 12, the damper plates do not extend out to the end of the outboard pontoons. Thus, their effectiveness in controlling pitch of the vessel would be reduced and with this reduced pitch control the survival depth of the vessel would parallel that of the prior art and the d/T ratio would be larger than with the FIG. 2 form of this invention. The use of the damper plates, however, would shift the phase of heave of the vessel and thus the vessel while riding deeper in the water would be riding with the waves in the manner of a cork to provide greater clearance below the platform as compared with the prior art vessels. While the pontoons would be at a lower survival level, the plates would be positioned approximately ten to fifteen feet above the top of the pontoons and would be in the regions where they would be exposed to greater damping forces to obtain the desired shift in phase and, of course, a reduction in heave as compared to the vessel without these damping plates.

FIGS. 13*a*, 13*b*, 14*a*, 14*b*, 15*a* and 15*b* illustrate the two-step stability transition as a semi-submersible constructed according to the principles of this invention ballast from a transit draft to operating mode. Stability is a function of volume, weight, vertical centers of volume and weight, and water plane inertia. This inertia is a function of water plane area and the area position in relation to the centerline axis; the more area or the farther away from the axis this area is positioned, the greater stability a vessel will possess. In FIGS. 13*a* and 13*b*, a semi-submersible constructed according to the principles of this invention with a stepped deck is shown floating at transit draft above the water line.

With the vessel afloat the water plane area of the outboard pontoons is $L_1$ times $W_1$ times four. The area of the columns is $L_2$ times $W_2$ times four. These areas together all provide the water plane area of the vessel afloat. During submergence, as shown in FIG. 14*a*, the water plane area of the inner pontoon will first submerge to a point below the water line while the water plane area of the columns and the outer pontoons remain above the water line. FIG. 15*a* illustrates the vessel with the water plane area of only the columns being present as both pontoons are below the water line. The advantage of this invention is that as the vessel is ballasted to sink from the transit mode of FIG. 13*a* to the operating mode of FIG. 15*a*, a stability transition occurs after the upper surface of the inner pontoons have submerged but before the upper surfaces of the outboard pontoons submerge. Instead of a water plane area suddenly reducing from the 13*a* configuration to the 15*a* configuration, as with a conventional semi-submersible, the water plane area will reduce first by the inner pontoon area as shown in FIG. 14*a*. A typical value of D, that is, the difference in height of the step provided by the inner pontoon and the outer pontoons of six feet would give a few hours in this transition stage. Then as the vessel sank further and the outer pontoons, go below the surface of the water, the water plane would reduce to that conventionally provided by just the columns. This stepped transition in water plane area will provide a much more stable platform than the conventional platform.

It will be appreciated from the above that the use of flat damping plates in shallow submergence during the survival mode of the vessel shifts the phase of the vessel to conform to wave action. By using the flat top outboard pontoons as damping surfaces pitch is controlled permitting the relatively shallow survival mode and the reduction in column height. By use of the stepped top surface and rake profile fore and aft, a major portion of volume can be removed from the outer pontoons while leaving the damper surfaces in the high force zone to develop magnified damping and added mass forces, both aiding motion control.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. In a semi-submersible vessel of the type comprising a platform, a plurality of columns extending downwardly from said platform and having sufficient buoyancy to substantially support the vessel and pontoons having inboard sections extending between said columns and outboard sections extending beyond said columns, the improvement comprising:

means for producing a heave action for said vessel in response to waves encountered by said vessel which heave action is substantially out of phase with said waves when said vessel is in a working mode in which working mode said pontoons are submerged at a first depth suitable for carrying out normal drilling operations and said heave action is substantially in phase with said waves when said vessel is in a survival mode, in which survival mode said pontoons are raised to a second depth which is shallower than said first depth, so as to provide additional clearance of said platform above the surface while maintaining said pontoons substantially fully submerged, whereby when said vessel is operated in a survival mode, it will ride with said waves so as to obtain maximum clearance of said platform above said waves.

2. The apparatus according to claim 1 wherein said means for providing said heave action enables said vessel to operate substantially 180° out of phase with said waves when said vessel is in said operating mode and substantially 0° out of phase with said waves when said vessel is in said survival mode.

* * * * *